US008479550B2

(12) United States Patent
Eckerstorfer et al.

(10) Patent No.: US 8,479,550 B2
(45) Date of Patent: Jul. 9, 2013

(54) METHOD FOR THE PRODUCTION OF HOT-ROLLED STEEL STRIP AND COMBINED CASTING AND ROLLING PLANT FOR CARRYING OUT THE METHOD

(75) Inventors: Gerald Eckerstorfer, Linz (AT); Gerald Hohenbichler, Kronstorf (AT); Josef Maierl, Neuhofen/Krems (AT)

(73) Assignee: Siemens Vai Metals Technologies GmbH (AT)

( * ) Notice: Subject to any disclaimer, the term of this patent is extended or adjusted under 35 U.S.C. 154(b) by 1122 days.

(21) Appl. No.: 12/092,905

(22) PCT Filed: Nov. 3, 2006

(86) PCT No.: PCT/EP2006/010553

§ 371 (c)(1),
(2), (4) Date: Jun. 2, 2008

(87) PCT Pub. No.: WO2007/054237

PCT Pub. Date: May 18, 2007

(65) Prior Publication Data

US 2008/0276679 A1 Nov. 13, 2008

(30) Foreign Application Priority Data

Nov. 9, 2005 (AT) ..... A 1830/2005

(51) Int. Cl.
*B21B 9/00* (2006.01)

(52) U.S. Cl.
USPC ..... 72/202; 72/200; 72/38

(58) Field of Classification Search
None
See application file for complete search history.

(56) References Cited

U.S. PATENT DOCUMENTS

| | | | | |
|---|---|---|---|---|
| 4,016,740 | A * | 4/1977 | Gondo et al. | 72/128 |
| 4,263,798 | A | 4/1981 | Wladika et al. | 72/202 |
| 4,528,834 | A * | 7/1985 | Aoyagi et al. | 72/202 |
| 4,727,747 | A | 3/1988 | Naud et al. | 72/38 |
| 5,634,257 | A | 6/1997 | Kajiwara | 29/527.7 |
| 5,697,241 | A | 12/1997 | Djumlija et al. | 72/39 |
| 5,816,311 | A | 10/1998 | Osada et al. | 164/415 |

(Continued)

FOREIGN PATENT DOCUMENTS

| | | |
|---|---|---|
| AT | 409 227 B | 6/2002 |
| CN | 1116136 A | 2/1996 |

(Continued)

OTHER PUBLICATIONS

Meriiam Webster Definition of "Immediately".*

(Continued)

*Primary Examiner* — Dana Ross
*Assistant Examiner* — Pradeep Battula
(74) *Attorney, Agent, or Firm* — Ostrolenk Faber LLP

(57) ABSTRACT

A method for the production of a hot-rolled steel strip from a steel melt in a continuous manufacturing process: continuously casting a steel strand in a continuous casting mold of a continuous casting plant, roll-forming the case steel strand in a first group of roll stands into a pre-rolled hot strip, roll-forming the pre-rolled hot strip in a second group of roll stands into a hot-rolled steel strip, setting the hot strip to a rolling temperature between the first and second groups, and winding or dividing the hot-rolled steel strip; further: descaling the hot strip before temperature setting, holding the hot strip in a protective gas atmosphere during temperature setting. A combined casting and rolling plant for the method is disclosed.

23 Claims, 2 Drawing Sheets

U.S. PATENT DOCUMENTS

| | | | | |
|---|---|---|---|---|
| 5,832,985 | A | 11/1998 | Pleschiutschnigg | 164/4.76 |
| 6,092,586 | A * | 7/2000 | Schonbeck | 164/476 |
| 6,109,336 | A * | 8/2000 | Pronk et al. | 164/476 |
| 6,216,770 | B1 | 4/2001 | Hensger et al. | 164/476 |
| 7,357,011 | B2 * | 4/2008 | Rittner et al. | 72/200 |
| 2004/0025979 | A1 | 2/2004 | Bruckner | 148/542 |

FOREIGN PATENT DOCUMENTS

| | | | |
|---|---|---|---|
| CN | 1260253 | A | 7/2000 |
| DE | 29 29 401 | A1 | 2/1981 |
| DE | 31 25 146 | A1 | 1/1983 |
| DE | 43 02 331 | A1 | 8/1994 |
| DE | 195 18 144 | | 11/1995 |
| DE | 195 18 144 | A1 | 11/1995 |
| DE | 196 13 718 | | 10/1997 |
| DE | 196 13 718 | C1 | 10/1997 |
| DE | 199 36 010 | A1 | 2/2001 |
| DE | 197 50 817 | | 3/2003 |
| JP | 56-144804 | | 11/1981 |
| JP | 58-77702 | | 5/1983 |
| JP | 62-187505 | | 8/1987 |
| JP | 4-66203 | | 3/1992 |
| JP | 4-231150 | | 8/1992 |
| JP | 07-308701 | | 11/1995 |
| JP | 8-309406 | | 11/1996 |
| JP | 09-192704 | | 7/1997 |
| JP | 9-220643 | | 8/1997 |
| JP | 09-308908 | | 12/1997 |
| JP | 10-277715 | | 10/1998 |
| JP | 10-510587 | | 10/1998 |
| JP | 10-306320 | | 11/1998 |
| JP | 11-511696 | | 10/1999 |
| JP | 2000-507503 | | 6/2000 |
| JP | 2004-509762 | | 4/2004 |
| RU | 2 163 934 | | 3/2001 |
| RU | 2 163 934 | C2 | 3/2001 |
| WO | WO 89/11363 | | 11/1989 |
| WO | WO 89/11363 | A1 | 11/1989 |
| WO | WO 98/00248 | A1 | 1/1998 |
| WO | WO 00/20141 | | 4/2000 |
| WO | WO 00/20141 | A1 | 4/2000 |
| WO | WO 2004/026497 | A1 | 4/2004 |
| WO | WO 2006/021263 | A1 | 3/2006 |

OTHER PUBLICATIONS

Priority Page from EPO regarding WO20020024969. Relevant to US 20040025979.*

Priority Page from EPO regarding WO1996012573. Relevant to JP 11-51696 and US 5832985.*

Priority Page from EPO regarding WO1997036699. Relevant to US 6092586 and JP2000-507503A.*

\English translation of Chinese Office Action dated Sep. 27, 2010 in corresponding Chinese Application No. 200680041649.1.

International Search Report dated Jan. 19, 2007 issued in corresponding PCT Application No. PCT/EP2006/010553.

Office Action dated May 22, 2012 issued in corresponding Japanese Patent Application No. 2008-539307 with English translation (6 pages).

EPO Communication and English translation dated Oct. 26, 2012 issued in corresponding Application/Patent No. 06 818.359.9-2302/1 951 451.

EPO Communication and English translation dated Oct. 26, 2012 issued in corresponding Application/Patent No. 06 818 359.9-2302/1 951 451.

* cited by examiner

METHOD FOR THE PRODUCTION OF HOT-ROLLED STEEL STRIP AND COMBINED CASTING AND ROLLING PLANT FOR CARRYING OUT THE METHOD

CROSS REFERENCE TO RELATED APPLICATION

The present application is a 35 U.S.C. §§371 national phase conversion of PCT/EP2006/010553, filed 3 Nov. 2006, which claims priority of Austrian Application No. A 1830/2005, filed Nov. 9, 2005. The PCT International Application was published in the German language.

BACKGROUND OF THE INVENTION

The invention relates to a method for the production of a hot-rolled steel strip in bundles or in sheets from a steel melt in a continuous manufacturing process, with an uninterrupted run through a combined casting and rolling plant, and to a combined casting and rolling plant for carrying out the method.

A method of this type comprises the following method steps: a steel strand is formed from liquid steel by continuous casting in a continuous casting mold of a continuous casting plant. In a following first group of roll stands, this cast steel strand is roll-formed into a pre-rolled hot strip, and, in a second group of roll stands, this pre-rolled hot strip is finish-rolled into a hot-rolled steel strip having the desired final dimensions and the desired material properties. Between the first group of roll stands and the second group of roll stands, a setting of the pre-rolled hot strip to the rolling temperature takes place in a temperature setting device, in order to achieve beneficial conditions for the finish-rolling. After finish-rolling, the hot-rolled steel strip runs through a cooling zone and is wound into bundles or divided into sheets.

Methods and arrangements of production apparatus for producing a hot-rolled steel strip starting from the liquid phase, which may come under a few basic types of method, are known in many variants from the prior art.

In a discontinuous process for generating a hot-rolled steel strip, liquid steel is cast on a continuous casting plant into a continuous steel strand, and the latter is divided into slabs having a casting thickness of more than 120 mm or into thin slabs having a casting thickness of between 40 mm and 120 mm. Subsequently, or with a time interruption as a consequence of production, these preproducts are rolled, after temperature compensation or basic reheating to rolling temperature, in rolling plants into steel strip having a specific target thickness. For this purpose, conventionally, a single-stand or multistand roughing train and a multistand finishing train are employed.

WO 98/00248 already discloses a combined casting and rolling plant for the production of a steel strip of deep-drawing quality, in which a steel strand having a casting thickness of less than 100 mm is cast in the continuous casting mold of a continuous casting plant. This cast steel strand is rolled, after descaling has been carried out, in a multistand roughing train at least to a windable strip thickness and, after running through an inductively heated furnace, in which a nonoxidizing protective gas atmosphere is maintained and in which the pre-rolled hot strip is heated to a temperature in the austenitic range, is wound into bundles and stored in an intermediate store. After the bundle has been unwound again, the pre-rolled hot strip is delivered to a finishing train and is rolled into a final product in the ferritic structural range. The rolling speed in the finishing train can be set specifically to the product by decoupling from the casting plant, irrespective of the specific requirements which are to be met by the plant arrangement and which arise from the special steel quality in this prior art. However, due to the winding and unwinding of the pre-rolled steel strip into bundles and the intermediate storage of these, considerably higher investment costs are incurred than in a continuous strip runthrough. A production method decoupled in this way, in which at least the rolling speed in the finishing train can be set independently of the casting speed in the continuous casting plant, is absolutely necessary in a multistrand casting plant. In single-strand casting plants, this decoupling may likewise be carried out and leads to the disadvantages described.

WO 89/11363 already discloses a continuous method of the generic type for the production of a hot-rolled steel strip, in which the casting speed at the exit from the continuous casting mold determines the rolling speed in the following respective forming stages as a function of the degree of forming in the respective forming stage. Only after exit from the last roll stand is the continuously cast and hot-rolled steel strip divided transversely according to the predetermined bundle weight and wound into bundles. Before the hot strip already pre-rolled in a roughing stand enters the finishing train, this hot strip is brought to a uniform strip temperature which lies above the rolling temperature, and is subsequently descaled immediately before entry into the finishing train. Descaling with water jets results in a temperature loss which has to be compensated by preceding heating to a temperature above the rolling temperature.

SUMMARY OF THE INVENTION

The object of the present invention is, therefore, to avoid the disadvantages of the known prior art and to propose a method for the production of a hot-rolled steel strip and a combined casting and rolling plant for carrying out this method, with a continuous and preferably uninterrupted strip runthrough from the continuous casting mold to the run through the last forming stage of the finishing train, a minimization of the additional introduction of energy into the hot strip being achieved by an optimization of the sequence of method steps and of the sequence of plant components.

The object on which the invention is based is, further, to minimize the investment costs for the combined casting and rolling plant according to the invention and to lower the operating costs for the production of the rolled steel strip, in particular the energy costs for additional strip heating.

The object on which the invention is based is, further, to increase the flexibility of the proposed production method and of the combined casting and rolling plant in terms of the possible production of hot-rolled steel strip within a wide range of steel qualities.

The object on which the invention is based is achieved by means of a method of the type initially described, in that the pre-rolled hot strip is descaled immediately before entry into the temperature setting device, the pre-rolled hot strip is held in a protective gas atmosphere in the temperature setting device, and the pre-rolled hot strip, after running through the temperature setting device, is roll-formed immediately thereafter in the second group of roll stands.

Since the hot strip, after being descaled, is held in a protective gas atmosphere within the temperature setting device, a further scaling process during the heating of the hot strip to the rolling temperature is as far as possible avoided, but at least kept within a range which does not cause any losses of quality on the hot strip surface in the following rolling operation, so that additional descaling immediately before entry into the roll stand is dispensed with. What is achieved by the sequence according to the invention of method steps is that the hot strip temperature set in the temperature setting device is essentially maintained until entry into the first forming stage of the second group of roll stands, and consequently a heating of the hot strip to a temperature above the rolling temperature is no longer necessary. The hot strip temperature can therefore be held at a temperature of up to 80° C. lower than in conventional methods with strip descaling directly upstream of the roll stand.

During the heating of the pre-rolled hot strip to the rolling temperature and during temperature compensation in the hot strip, the latter is held in the temperature setting device in an inert protective gas atmosphere having an oxygen content of less than 10.0% by volume. The oxygen content preferably lies below 2.0% by volume. The protective gas atmosphere consists predominantly of nitrogen.

According to a further embodiment, the pre-rolled hot strip can be held in a reducing protective gas atmosphere in the temperature setting device during heating to the rolling temperature. As a result, the oxygen sometimes flowing through entry or exit orifices of the protective gas chamber surrounding the temperature setting device is bound, and scaling on the strip surface is avoided.

Preferably, the pre-rolled hot strip is set to a predetermined roll entry temperature in the temperature setting device. Optimal conditions for the rolling operation in the second group of roll stands are afforded when the pre-rolled hot strip is set in the temperature setting device, as a function of the current casting speed, to a roll entry temperature which makes it possible to have, in the last forming stage of the second group of roll stands, a final rolling temperature which lies in the austenitic structural range of the hot strip. Expediently, in addition to the current casting speed, the degree of reduction of the strip thickness in the first group of roll stands is also taken into account.

Expediently, the pre-rolled hot strip, immediately before entry into the temperature setting device, is descaled by means of water jets at a jet pressure of between 200 bar and 450 bar. Rotating water jets directed obliquely against the strip surface and emanating from a rotor descaling device are preferably used.

The method described may be used particularly advantageously when a steel strand having a steel strand thickness of between 50 and 150 mm is cast in the continuous casting mold, the cast steel strand is subsequently roll-formed in a first group of roll stands into a pre-rolled hot strip having a hot strip thickness of between 6.0 and 30 mm, and, further, the pre-rolled hot strip is hot-formed in a second group of roll stands into a hot-rolled steel strip having a final steel strip thickness of between 0.6 and 5.0 mm.

The casting thickness at the exit from the continuous casting mold essentially determines the number of following roll stands. The roll-forming of the cast steel strand in the first group of roll stands takes place, as a function of the casting thickness, by means of at least one roll stand, preferably by means of three successive roll stands. Further, the hot-forming of the pre-rolled hot strip in the second group of roll stands takes place by means of at least two, preferably by means of three to five successive roll stands.

According to one possible embodiment of the invention, the pre-rolled hot strip is divided transversely between the first group of roll stands and the descaling device. Consequently, the hot-forming of the cast steel strand in the first group of roll stands is coupled to the casting process, and the further hot-forming in the second group of roll stands is decoupled from the casting process and can therefore be carried out uninfluenced by the latter. Consequently, preferably for thicker strips, this affords the possibility of finish-rolling these by the conventional leading pass method.

A combined casting and rolling plant for carrying out the method according to the invention comprises a continuous casting plant with a continuous casting mold for the production of a cast steel strand, a first group of roll stands for the roll-forming of the cast steel strand into a pre-rolled hot strip, a second group of roll stands for the roll-forming of the pre-rolled hot strip into a hot-rolled steel strip, a temperature setting device between the first group of roll stands and the second group of roll stands, and a strip coiling device for winding the hot-rolled steel strip into bundles or a dividing device for dividing the hot-rolled steel strip into sheets. An arc-type continuous casting plant with an oscillating continuous casting mold is preferably employed.

To achieve the set object, the combined casting and rolling plant is characterized in that the temperature setting device is arranged in a closed protective gas chamber which is equipped with entry and exit orifices for the pre-rolled hot strip and with supply lines for a protective gas, in that a descaling device directly precedes the protective gas chamber, and in that the second group of roll stands directly follows the protective gas chamber. This arrangement ensures that no relevant scaling of the steel strip occurs on the transport path of the steel strip from entry into the protective gas chamber to entry into the first following roll stand and no relevant temperature loss occurs on the transport path of the steel strip from the exit from the protective gas chamber to entry into the first following roll stand.

Preferably, the temperature setting device is designed as an induction heating device, since this allows a reinforced strip edge heating and, where appropriate, a zone-dependently different heating of the steel strip within a very short runthrough time. Further, an inductive heating device of this type makes it possible to have a highly compact type of construction of the temperature setting device, with the result that the erection and operation of the protective gas chamber are also possible cost-effectively.

According to a preferred embodiment, the descaling device is formed by at least one rotor descaling device. A rotor descaling device of this type is already known, for example, from EP 640 413 for the descaling of rolling stock directly upstream of a roll stand. Expediently, a plurality of rotor descaling devices are arranged directly upstream of the protective gas chamber, parallel to the entry orifice of the latter.

For largely avoiding a renewed scaling of the steel strip before entry into the first roll stand of the second group of roll stands, the exit orifice of the protective gas chamber comprises an exit duct which terminates at most 5.0 m, preferably at most 3.0 m, upstream of the roll nip of the first roll stand of the second group of roll stands. Although, according to experience, at the strip speeds occurring along this short distance, there is there a renewed build up of a scale layer with a scale layer thickness of at most 8 μm, this does not cause any problems with regard to the surface quality of the rolling stock.

According to one possible variant of the combined casting and rolling plant, cross-dividing shears preferably designed as pendulum shears for dividing the pre-rolled hot strip transversely are arranged between the first group of roll stands and the descaling device. The separated hot strip sections can be finish-rolled according to the conventional leading pass method.

Further advantages and features of the present invention may be gathered from the following description of a nonrestrictive exemplary embodiment, reference being made to the accompanying figures in which:

DESCRIPTION OF A PREFERRED EMBODIMENT

Figure 1:
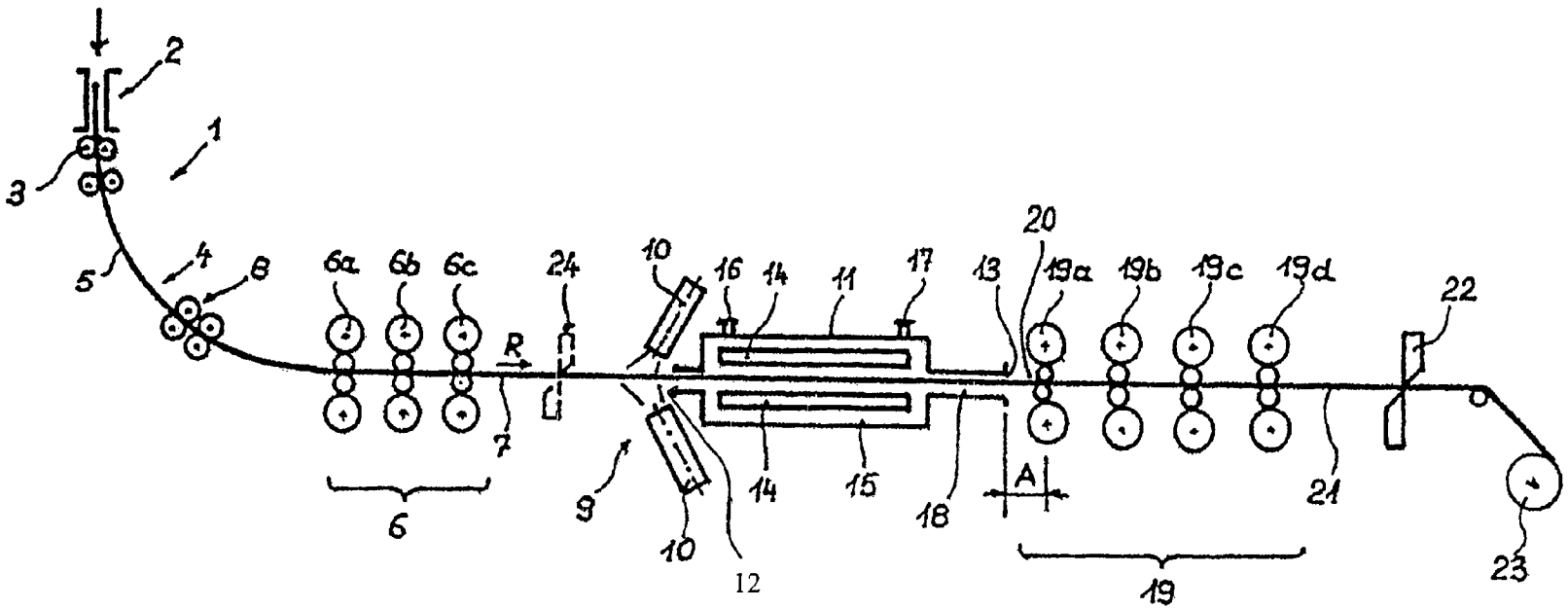
FIG. 1 shows a diagrammatic illustration of a combined casting and rolling plant for the production of a hot-rolled steel strip.

A combined casting and rolling plant for the production of a hot-rolled steel strip from liquid steel in a continuous inline production process comprises an arc-type continuous casting plant 1 of a conventional type of construction, which is illustrated diagrammatically in FIG. 1 merely by a continuous casting mold 2 and some of the following strand guide rolls 3 in the strand guide 4 indicated by the arcuate steel strand run. In the cooled continuous casting mold 1, liquid steel is formed into a steel strand 5 having the cross section of a slab or of a thin slab. Conventional steel strand thicknesses are between 40 and 150 mm. The casting speed in these plants lies between 4.0 and 8.0 m/min and is very substantially dependent on the steel quality.

The cast steel strand 5 deflected in the strand guide 4 of the continuous casting plant into a horizontal strip transport direction R runs, further, through a first group of roll stands 6 consisting of three roll stands 6*a*, 6*b*, 6*c* which form a roughing stand group and in which the cast steel strip 5 is formed into a pre-rolled hot strip 7 having a hot strip thickness of between 6 and 30 mm. In this case, the cast steel strip is reduced in thickness in each of the roll stands with a degree of reduction of up to 60%.

In this region of the plant, normally, further plant components are positioned, which are not illustrated in detail here, such as, for example, a straightening unit at the end of the continuous casting plant for straightening the cast steel strand into the horizontal strip transport direction, an emergency cutting device upstream or downstream of the first group of roll stands, which is additionally used for detaching the dummy strand head, cross-dividing shears between the first group of roll stands and the descaling device or the protective gas chamber for the chopping of scrap sheets, as required, and a descaling device upstream of the first roll stand group for removing the surface scale from the cast steel strand. In addition, one or more forming units 8, consisting of driver rolls, for a reduction in thickness of the steel strand while the core is still liquid (liquid core soft-reduction) may be arranged in the strand guide.

After the first roll-forming in the first group of rolls stands 6, the pre-rolled hot strip 7 is descaled on both sides in a descaling device 9. This descaling device comprises a number of rotor descaling devices 10 which are arranged in at least one row, transversely to the strip running direction R, directly upstream of a protective gas chamber 11. By means of the rotor descaling devices 10, rotating water jets with a jet pressure of 200 to 450 bar are directed obliquely against the surface of the pre-rolled hot strip, and a virtually complete descaling of the strip surface is achieved. Further descaling devices may also be used.

The descaling device 9 is directly followed by a protective gas chamber 11 which is equipped with an entry orifice 12 and an exit orifice 13 for leading through the pre-rolled hot strip and which has temperature setting devices 14 for the reheating and temperature compensation of the hot strip. These temperature setting devices are designed as induction heating devices 15, thus ensuring, as required, a rapid introduction of heat into the hot strip moved past the heating devices. A zone-related heating of the hot strip is thereby also possible, in particular reinforced heating in the strip edge region. In the protective gas chamber, the hot strip is brought to a roll entry temperature which is necessary for the subsequent finish-rolling and which depends at least on the number of following roll stands and on the desired target material properties of the finish-rolled steel strip.

The protective gas chamber 11 is equipped with supply lines 16, 17 and with corresponding regulating devices for the supply and discharge of a largely inert or reducing protective gas for maintaining a predetermined protective gas atmosphere.

The exit orifice 13 of the protective gas chamber 11 comprises an exit duct 18 which surrounds the pre-rolled hot strip, shields it from the ambient atmosphere and transfers it to the second group of roll stands 19. The free distance A between the exit orifice 13 of the exit duct 18 and the roll nip 20 of the first roll stand 19*a* amounts to no more than 5.0 m, in order to avoid a relevant rescaling of the hot strip. The four roll stands 19*a* to 19*d* form a finishing train, in which the pre-rolled hot strip 7 is finish-rolled into a hot-rolled steel strip 21 having the desired target thickness, which is between 0.6 and 5.0 mm, and having the predetermined material properties.

Finally, the steel strip 21 is divided transversely by means of cross-dividing shears 22 and is wound into bundles in a strip coiling device 23. The steel strip may equally be divided by means of the cross-dividing shears into sheets which are subsequently stacked into sheet packages in a stacking plant.

The cross-dividing shears 24, illustrated by dashed lines, between the first group of roll stands 6 and the descaling device 9 makes it possible to decouple the combined casting and rolling process at this point, so that, particularly in the case of larger hot strip thicknesses, the pre-rolled hot strip 7 can enter the following second group of roll stands 19 in the conventional leading pass method.

The invention is in no way restricted to a second group of roll stands of the type described. It is perfectly possible that, between the individual roll stands of the second roll stand group, intermediate stand heatings are arranged, by means of which the strip temperature is raised when metallurgical or rolling demands require this. Moreover, further individual roll stands or groups of roll stands may be arranged upstream or downstream of the cross-dividing shears.

Figure 2:
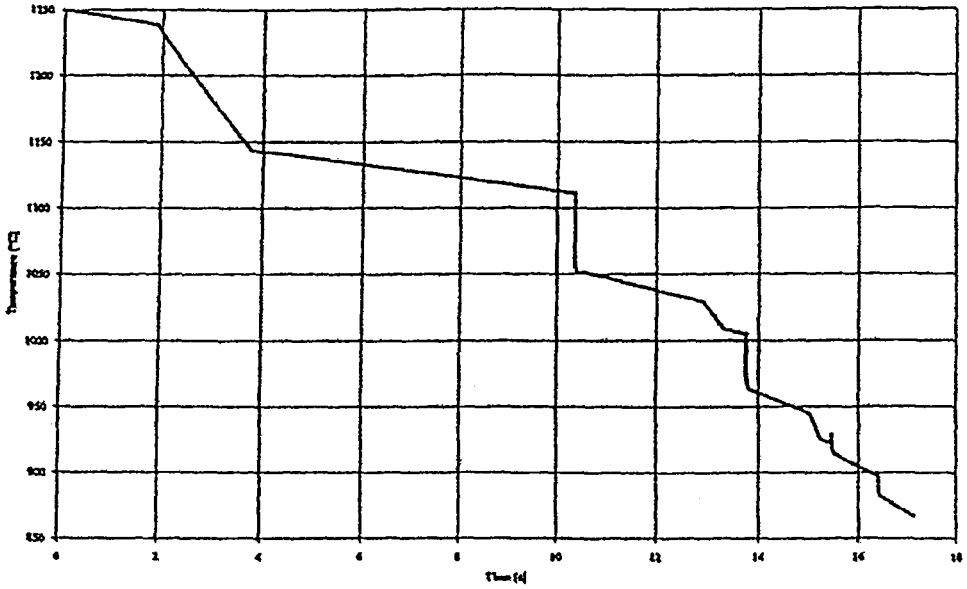
Fig. 2 PRIOR ART
FIG. 2 shows the temperature profile on the steel strip after exit from an induction heating device according to the prior art with descaling upstream of the second group of roll stands.
Figure 3:
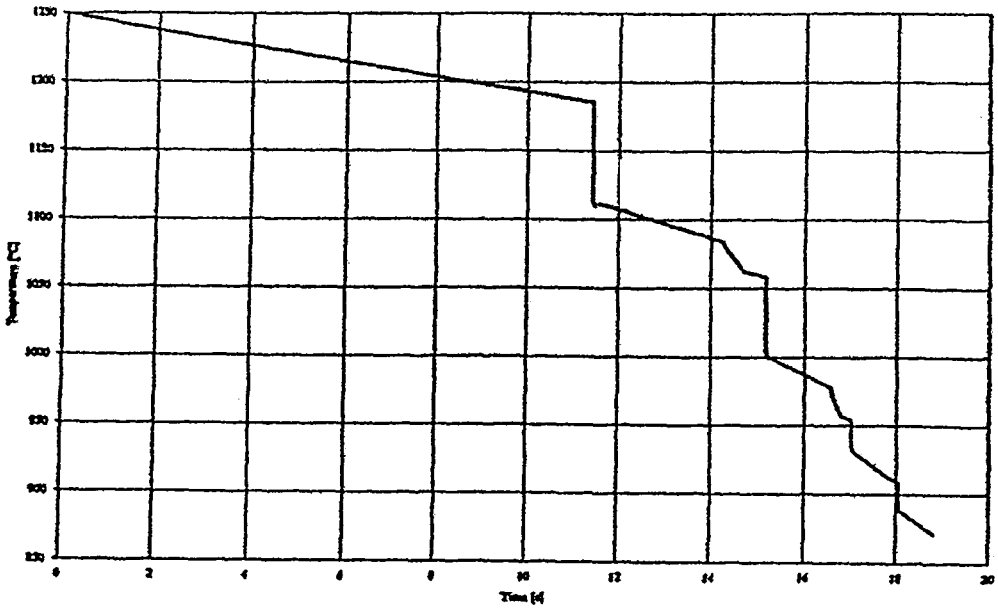
FIG. 3 shows the temperature profile on the steel strip after exit from an induction heating device in the method according to the invention with descaling upstream of the induction heating device.

In FIGS. 2 and 3, the temperature profiles on the pre-rolled hot strip (prestrip) from the exit from the temperature setting device or the protective gas chamber until final rolling thickness is reached in the roll nip of the last roll stand of a second group of roll stands formed by five roll stands (finishing group) for two types of method are compared. FIG. 2 illustrates the temperature profile of the prestrip in the case of a plant configuration corresponding to the prior art in which the descaling device is arranged between the temperature setting device and the finishing group. By contrast, FIG. 3 illustrates the temperature profile of the prestrip in the case of a plant configuration according to the invention, in which the descaling device is arranged upstream of the protective gas chamber and the protective gas chamber is arranged as closely as possible upstream of the finishing group.

Both temperature profiles are based on the production of a hot-rolled steel strip of steel quality DD12 with a desired final rolling thickness of 1.0 mm. The maximum temperature upon leaving the temperature setting device or the protective gas chamber typically amounts to approximately 1250° C. for this steel quality. At higher temperatures, undesirable local melting of the strip may occur. When a descaling device is arranged upstream of the finishing group, the descaling results in an average temperature loss of about 70° C. before the prestrip runs into the finishing group.

In the instance illustrated, the minimum casting speed for achieving a final rolling temperature in the austenitic structural range of 850° C. in the last roll stand amounts to 6.3 m/min in the case of a steel strand thickness of 70 mm at the exit from the continuous casting mold. The prestrip thickness after exit from the first group of three roll stands amounts to 14 mm. In this case (FIG. 2), the temperature loss at the descaling device amounts to approximately 95° C., and the run-in temperature into the first roll stand of the finishing group is approximately 1110° C.

The result of this is that a final rolling temperature above 850° C. cannot be reached for this steel quality at casting speeds of below 6.3 m/min and under the boundary conditions described above. Consequently, even the required quality standards arising from the structure during rolling cannot be achieved.

FIG. 3 shows the temperature profile in the case of a prestrip in which descaling has already taken place before entry into the protective gas chamber and which, after exit from the protective gas chamber, is introduced directly into the finishing group. In this case, the protective gas chamber is at a distance of 3.0 m from the roll nip of the first roll stand. All the other boundary conditions (steel quality, final thickness, initial temperature, etc.) correspond to the boundary conditions of the comparative example.

Likewise on the basis of a temperature of 1250° C. upon exit from the protective gas chamber, the run-in temperature into the first roll stand of the finishing group is in this case approximately 1185° C. A further increase in the run-in temperature in the amount of 20 to 30° C. may be achieved by means of a corresponding thermal insulation of the protective gas chamber and of the exit duct up to near the first roll stand of the finishing group. The minimum casting speed for achieving a desired final rolling temperature of 850° C. under these boundary conditions is in this case 5.8 m/min, that is to say 0.5 m/min lower than in the plant configuration according to the prior art.

Since not all steel qualities can be produced with identical casting speeds, the field of use and the flexibility of the combined casting and rolling plant according to the invention are markedly extended due to the proposed method.

The invention claimed is:

1. A method for production of a hot-rolled steel strip in bundles or in sheets from a steel melt in a continuous manufacturing process, with an uninterrupted strip runthrough, having the following steps in sequence:

continuous casting a steel strand in a continuous casting mold of a continuous casting plant, roll-forming the cast steel strand in a first group of roll stands into a pre-rolled hot strip, roll-forming of the pre-rolled hot strip in a second group of roll stands into a hot-rolled steel strip, descaling the pre-rolled hot strip after the first group of roll strands and immediately before entry of the hot strip into a temperature setting device, setting the pre-rolled hot strip to a rolling temperature in a temperature setting device after the hot strip passes the first group of roll stands and after the descaling and before the second group of roll stands, holding the pre-rolled hot strip in a protective gas atmosphere in the temperature setting device, immediately after the pre-rolled hot strip runs through the temperature setting device, roll-forming the hot strip in the second group of roll stands, and winding the hot-rolled steel strip into bundles or dividing the hot-rolled steel strip into sheets.

2. The method as claimed in claim 1, wherein the holding of the pre-rolled hot strip in the temperature setting device is in an inert protective gas atmosphere having an oxygen content of less than 10%.

3. The method as claimed in claim 1, wherein the holding of the pre-rolled hot strip in the temperature setting device is in a reducing protective gas atmosphere.

4. The method as claimed in claim 1, further comprising setting the pre-rolled hot strip to a roll entry temperature in the temperature setting device.

5. The method as claimed in claim 4, further comprising setting the pre-rolled hot strip in the temperature setting device, as a function of a current casting speed, and to a roll entry temperature which makes it possible to have, in a last forming stage of the second group of roll stands, a final rolling temperature which lies in an austenitic structural range of the hot strip.

6. The method as claimed in claim 1, further comprising before entry of the pre-rolled hot strip into the temperature setting device, descaling the pre-rolled hot strip by water jets at a nozzle admission pressure of between 200 bar and 450 bar.

7. The method as claimed in claim 1, wherein the roll-forming in the first group of roll stands is by at least one roll stand.

8. The method as claimed in claim 1, wherein the roll-forming in the second group of roll stands is by at least two successive roll stands.

9. The method as claimed in claim 1, further comprising casting the steel strand to have a steel strand thickness of between 50 and 150 mm in the continuous casting mold, roll-forming the cast steel strand in the first group of roll stands into a pre-rolled hot strip a thickness of between 6.0 and 30 mm, hot-forming the pre-rolled hot strip in the second group of roll stands into a hot-rolled steel strip having a final steel strip thickness of between 0.6 and 5.0 mm.

10. The method as claimed in claim 1, further comprising dividing the pre-rolled hot strip transversely between the first group of roll stands and the descaling device.

11. The method as claimed in claim 1, wherein the roll-forming in the first group of roll stands is by three successive roll stands.

12. The method as claimed in claim 1, wherein the roll-forming in the second group of roll stands is by three to five successive roll stands.

13. A combined casting and rolling plant comprising a continuous casting mold for the production of a cast steel strand comprising, a first group of roll stands operable for receiving the cast steel strand and for roll-forming of the cast steel strand into a pre-rolled hot strip, a second group of roll stands operable for receiving the hot strip from the first group of roll stands and for roll-forming of pre-rolled hot strip into a hot-rolled steel strip, a temperature setting device between the first group of roll stands and the second group of roll stands, a closed protective gas chamber in which the temperature setting device is arranged, the setting device has entry and exit orifices for the pre-rolled hot strip and has supply lines for a protective gas, a descaling device directly preceding the protective gas chamber, the second group of roll strands directly following the protective gas chamber, and a strip coiling device for winding the hot-rolled steel strip into bundles or a dividing device for dividing the hot-rolled steel strip into sheets.

14. The combined casting and rolling plant as claimed in claim 13, wherein the temperature setting device comprises an induction heating device.

15. The combined casting and rolling plant as claimed in claim 13, wherein the descaling device comprises at least one rotor descaling device.

16. The combined casting and rolling plant as claimed in claim 15, further comprising a plurality of the rotor descaling devices arranged directly upstream of the protective gas chamber, and parallel to the entry orifice of the gas chamfer.

17. The combined casting and rolling plant as claimed in claim 13, wherein the first group of roll stands comprises at least one roll stand.

18. The combined casting and rolling plant as claimed in claim 13, wherein the second group of roll stands comprises at least two roll stands.

19. The combined casting and rolling plant as claimed in claim 13, wherein the exit orifice of the protective gas chamber comprises an exit duct which terminates at most 5.0 m upstream of a roll nip of a first roll stand of the second group of roll stands.

20. The combined casting and rolling plant as claimed in claim 13, further comprising cross-dividing shears arranged between the first group of roll stands and the descaling device and operable for transversely dividing the pre-rolled hot strip.

21. The combined casting and rolling plant as claimed in claim 13, wherein the first group of roll stands comprises three successive roll stands.

22. The combined casting and rolling plant as claimed in claim 13, wherein the second group of roll stands comprises three to five roll stands.

23. The combined casting and rolling plant as claimed in claim 13, wherein the exit orifice of the protective gas chamber comprises an exit duct which terminates at most 3.0 m upstream of a roll nip of a first roll stand of the second group of roll stands.

* * * * *

UNITED STATES PATENT AND TRADEMARK OFFICE

CERTIFICATE OF CORRECTION

PATENT NO. : 8,479,550 B2
APPLICATION NO. : 12/092905
DATED : July 9, 2013
INVENTOR(S) : Eckerstorfer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1315 days.

Signed and Sealed this
Eighth Day of September, 2015

Michelle K. Lee

Michelle K. Lee
*Director of the United States Patent and Trademark Office*